US011315399B2

(12) United States Patent
Swiss

(10) Patent No.: US 11,315,399 B2
(45) **Date of Patent: *Apr. 26, 2022**

(54) SECURITY CAMERA WITH ADAPTABLE HOOD

(71) Applicant: LightCam LLC, South Jordan, UT (US)

(72) Inventor: Daniel Swiss, South Jordan, UT (US)

(73) Assignee: Lightcam LLC, South Jordan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/925,056

(22) Filed: Jul. 9, 2020

(65) Prior Publication Data

US 2021/0097828 A1 Apr. 1, 2021

Related U.S. Application Data

(63) Continuation of application No. 16/101,266, filed on Aug. 10, 2018, now Pat. No. 10,748,398.

(51) Int. Cl.
*G08B 13/196* (2006.01)
*F21V 33/00* (2006.01)

(52) U.S. Cl.
CPC .... *G08B 13/19619* (2013.01); *F21V 33/0076* (2013.01); *G08B 13/19626* (2013.01); *G08B 13/19632* (2013.01)

(58) Field of Classification Search
None
See application file for complete search history.

(56) References Cited

U.S. PATENT DOCUMENTS

| | | | |
|---|---|---|---|
| 4,205,895 | A | 6/1980 | Yurdin et al. |
| D435,576 | S | 12/2000 | McBride |
| 7,688,195 | B2 | 3/2010 | Yeh et al. |
| 8,562,158 | B2 | 10/2013 | Chien |
| 9,053,622 | B2 | 6/2015 | Scalisi |

(Continued)

FOREIGN PATENT DOCUMENTS

| | | |
|---|---|---|
| DE | 10064098 | 7/2002 |
| WO | 2015005510 | 1/2015 |

(Continued)

OTHER PUBLICATIONS

Michael Zhang, "The Ultimate Lens Hood Lets You Shoot Reflection-Free Through Glass", Jul. 31, 2018, https://petapixel.com/2018/07/31/the-ultimate-lens-hood-lets-you-shoot-reflection-free-through-glass/ (Year: 2018) (Year: 2018).*

(Continued)

*Primary Examiner* — Kaitlin A Retallick
(74) *Attorney, Agent, or Firm* — Stoel Rives LLP

(57) ABSTRACT

A security device comprising a body having a first end and a second end, the first end being threadable into a light socket and the second end having a rotatable mount disposed thereon. The body may also include a light source disposed on the body of the security device and a slide connected to the rotatable mount, wherein the slide is configured to extend away from the mount. A camera with a lens may be disposed on a distal portion of the slide. The security device may further include a hood surrounding the lens of the camera and extending beyond the lens of the camera.

11 Claims, 11 Drawing Sheets

(56) References Cited

U.S. PATENT DOCUMENTS

| | | | | |
|---|---|---|---|---|
| D740,873 | S | 10/2015 | Scalisi | |
| 9,165,444 | B2 | 10/2015 | Scalisi | |
| 9,172,917 | B1 | 10/2015 | Fu et al. | |
| 9,228,731 | B2 | 1/2016 | Chen | |
| D749,161 | S | 2/2016 | Scalisi | |
| 9,305,198 | B2 | 4/2016 | Thompson et al. | |
| 9,654,678 | B1 | 5/2017 | Fu et al. | |
| 9,992,389 | B1 | 6/2018 | Fu et al. | |
| 2003/0197807 | A1 | 10/2003 | Wu | |
| 2010/0103664 | A1* | 4/2010 | Simon | G08B 13/19619 362/234 |
| 2012/0218421 | A1 | 8/2012 | Chien | |
| 2013/0169814 | A1 | 7/2013 | Liu | |
| 2014/0313406 | A1 | 10/2014 | Becker | |
| 2015/0249777 | A1 | 9/2015 | Chen | |
| 2015/0373307 | A1* | 12/2015 | Huang | G05B 15/02 348/155 |
| 2016/0100086 | A1* | 4/2016 | Chien | G01J 5/089 348/143 |
| 2016/0134826 | A1 | 5/2016 | Scalisi | |
| 2016/0134846 | A1 | 5/2016 | Miller et al. | |
| 2017/0180829 | A1 | 6/2017 | Schwarzkopf et al. | |
| 2017/0339343 | A1 | 11/2017 | Zhang et al. | |
| 2018/0035084 | A1 | 2/2018 | Swiss et al. | |
| 2018/0332204 | A1* | 11/2018 | Chien | F21V 21/30 |
| 2020/0051412 | A1 | 2/2020 | Swiss | |

FOREIGN PATENT DOCUMENTS

| | | | |
|---|---|---|---|
| WO | 2016032217 | 3/2016 | |
| WO | WO-2016032217 A1 * | 3/2016 | H04N 7/18 |

OTHER PUBLICATIONS

Clinton , "Say No to Conduit! Try Telescoping Camera Poles for Pendant Mount CCTV Cameras", Mar. 11, 2015, Clinton Electronics, pp. 1-7 (Year: 2015).

May , "Shooting Through Glass: 12 Tricks to Take Better Photos", Sep. 17, 2013, Photograph Tricks, pp. 1-9 (Year: 2013).

Swiss , Notice of Allowance dated Apr. 9, 2020 for U.S. Appl. No. 16/101,266.

Swiss , Office Action dated Dec. 4, 2019 for U.S. Appl. No. 16/101,266.

Swiss , Office Action dated May 28, 2019 for U.S. Appl. No. 16/101,266.

Swiss , et al., Notice of Allowance dated Oct. 2, 2019 for U.S. Appl. No. 15/660,964.

Swiss , et al., Office Action dated Feb. 27, 2019 for U.S. Appl. No. 15/660,964.

Swiss , et al., Office Action dated Jun. 19, 2019 for U.S. Appl. No. 15/660,964.

Swiss , et al., Office Action dated Oct. 17, 2018 for U.S. Appl. No. 15/660,964.

Zhang , "The Ultimate Lens Hood Lets You Shoot Reflection-Free Through Glass", Jul. 31, 2018, https://petapixel.com/2018/07/31/the-ultimate-lens-hood-lets-you-shoot-reflection-free-through-glass/ (Year: 2018).

* cited by examiner

SECURITY CAMERA WITH ADAPTABLE HOOD

RELATED APPLICATIONS

This application is a continuation of U.S. patent application Ser. No. 16/101,266, filed Aug. 10, 2018 and titled SECURITY CAMERA WITH ADAPTABLE HOOD, which is hereby incorporated herein by reference in its entirety.

TECHNICAL FIELD

The present disclosure relates generally to the field of cameras for use with security systems. More particularly, some embodiments relate to a camera that can be powered at a light socket and combined with a light source, where the camera can interface with a light feature.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Figure 1:
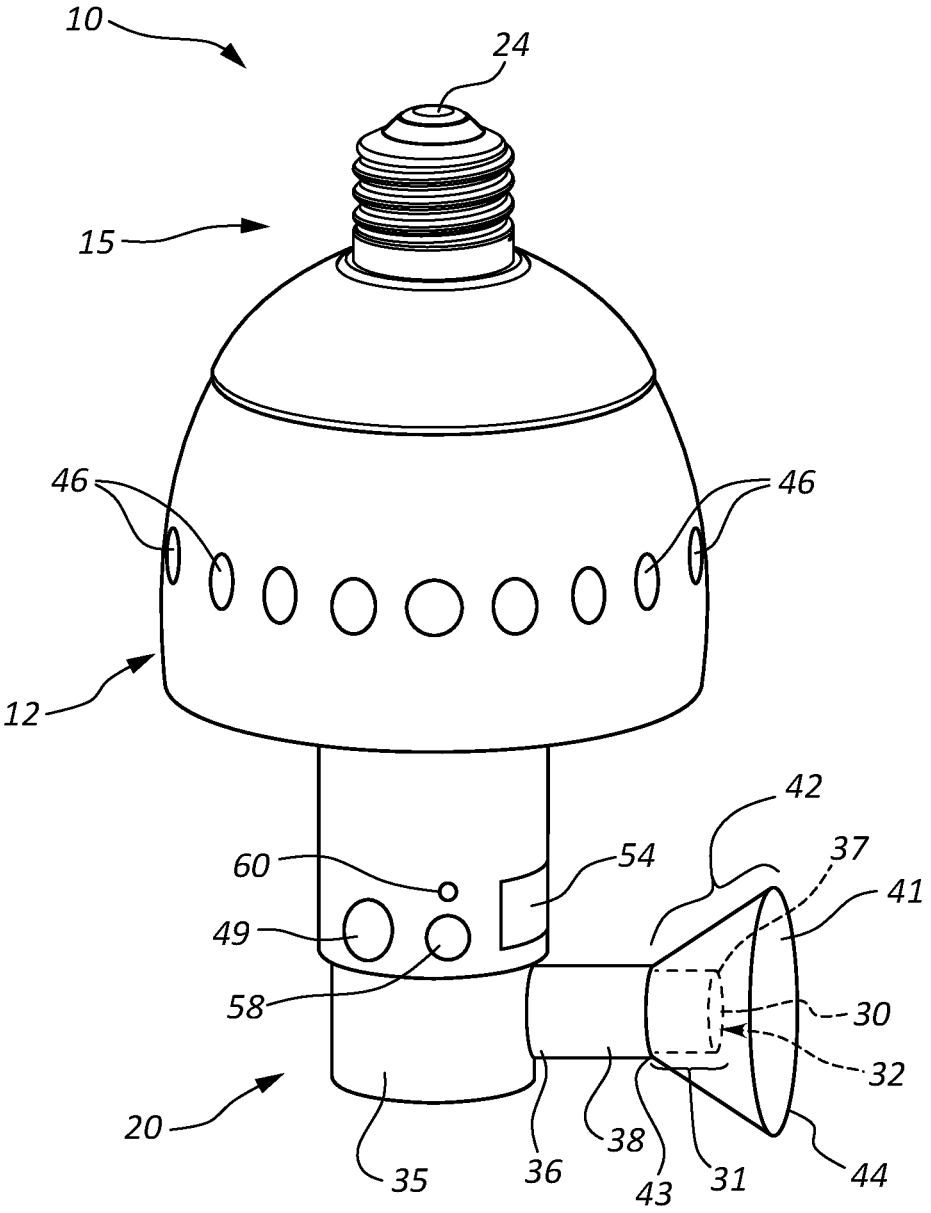
FIG. 1 is a perspective view of a security device according to one embodiment of the present disclosure.

A security device may combine a light source with a camera. An exemplary disclosure of such a security device may be found in U.S. patent application Ser. No. 15/660,964, filed Jul. 27, 2017, which is incorporated by reference in its entirety. Such security devices may be inserted into and receive power from a conventional light socket. In some situations, such a security device may be placed within a light fixture, such as an outdoor carriage lamp that is common to many homes. When a barrier such as glass of the light fixture is positioned between the camera of the security device and the area to be recorded (e.g. image/video captured) by the camera, glare from the barrier or other related issues may degrade the image quality. For example, light from the security device may reflect from the glass surface into the camera, thereby creating glare that can degrade image quality. The camera may be advanced to press directly against the barrier, which may reduce problems such as glare. Alternatively or in addition, a hood may be provided to surround the camera, thereby reducing glare on the camera's lens.

A hood of presently available security devices may not be sufficiently large to shield the camera from unwanted input such as reflected light from a light fixture. Also, if the camera of the security device has a hood and is advanced to press against a barrier such as glass from a light fixture, the hood may fail to conform to the shape of the light fixture and therefore fail to shield the camera from some reflected light. For example, if the security device were installed in a light socket and a curved light fixture (e.g., curved glass) were disposed around the security device, a conventional hood around the camera may not fully press against the curved light fixture. Specifically, portions of the perimeter of the hood may contact the curved glass of the curved light fixture, but some portions of the perimeter of the hood may be positioned at a distance away from the light fixture, thereby allowing unwanted light to reach the camera to create glare.

Alternatively, if the camera with a hood is positioned behind a flat glass surface and is tilted such that it is not facing the normal side of the glass surface, the perimeter of the conventional hood may only contact the glass surface on one side rather than on all sides, thereby failing to shield the camera from reflected light. Further, if a camera with a hood were positioned such that all portions of the perimeter of the hood contacted a glass surface, and the camera were to be rotated or directed elsewhere, portions of the perimeter of the hood may cease to contact the glass surface, thereby allowing unwanted reflected light to reach the camera and create glare.

The present disclosure provides descriptions and details directed to an improved security camera device with various configurations of hoods to surround the camera. According to various embodiments, the hood may be made from a flexible material such as rubber or plastic and may extend beyond the lens of the camera. For example, the hood may extend outward away from a body of the security device beyond the lens in a viewing direction of the lens. In various applications, the hood may be configured to engage the glass of a light feature or fixture such that all portions of the perimeter of the hood contact the light feature or fixture. In one embodiment, the hood may have a truncated cone shape. In another embodiment, the hood may be accordion shaped such that elbows of the accordion shaped hood may bend and opposing elbows of the accordion shaped hood may extend to enable the hood to engage the glass on all portions of the perimeter of a distal end of the hood. In another embodiment, the hood may have a plurality of nesting cylinders such that elbows of the nesting cylinders may bend (e.g., collapse or nest together) and opposing elbows of the nesting cylinders may extend to enable the hood to engage the glass on all portions of the perimeter of the hood.

The components of the embodiments as generally described and illustrated in the figures herein can be arranged and designed in a wide variety of different configurations. Thus, the following more detailed description of various embodiments, as represented in the figures, is not intended to limit the scope of the present disclosure, but is merely representative of various embodiments. While various aspects of the embodiments are presented in drawings, the drawings are not necessarily drawn to scale unless specifically indicated.

The phrase "coupled to" is broad enough to refer to any suitable coupling or other form of interaction between two or more entities, including mechanical and electrical. Thus, two components may be coupled to each other even though they are not in direct contact with each other. The phrases "attached to" or "attached directly to" refer to interaction between two or more entities which are in direct contact with each other and/or are separated from each other only by a fastener of any suitable variety (e.g., mounting hardware or an adhesive).

The terms "proximal" and "distal" are opposite directional terms. For example, the distal end of a device or component is the end of the component that is furthest from the device. The proximal end refers to the opposite end, or the end nearest the device.

FIG. 1 illustrates a perspective view of a security device 10 capable of being threaded into a light socket (e.g., bulb socket). This makes it possible to screw the device into a conventional light socket arrangement, such as a recessed lighting fixture, outdoor carriage light, etc. The security device 10 may comprise a light source 46 and a camera 30. Once the security device 10 is installed, a transparent covering may be positioned around the security device 10. Light from the light source 46 of the security device 10 may reflect off of the surface of the transparent covering and into the camera 30 of the security device 10 creating a glare that may distort an image recorded by the camera 30. The security device 10 may include a hood 41 that is configured to surround a lens 32 of the camera 30 and thereby reduce or eliminate glare.

According to the embodiment of FIG. 1, the security device 10 may comprise a body 12 with a first end 15 and a second end 20. The first end 15 of the body 12 may comprise electrical contacts 24 sized and threaded to mimic a light bulb base so as to be threadable into a light socket. The security device 10 may comprise an extendable and/or rotatable mount 35 that is coupled to the second end 20 of the body 12 of the security device 10. Further, the security device 10 may also comprise an extendable and/or rotatable slide 38 that may be coupled to the rotatable mount 35 on a first (proximal) end 36 and to the camera 30 on a second (distal) end 37. The slide 38 may function as a camera movement means.

The security device 10 may also comprise a hood 41 that surrounds the camera 30. According to the embodiment of FIG. 1, the hood 41 may be coupled to the slide 38 of the security device 10 at or near the second (distal) end 37 of the slide 38. Specifically, the hood 41 comprises a proximal end 43 and a distal end 44. According to the embodiment of FIG. 1, the proximal end 43 of the hood 41 may be coupled to the slide 38 at or near the second (distal) end 37 of the slide 38. The hood 41 of the security device 10 may extend outward beyond the lens 32 of the camera 30 of the security device 10 and thereby eliminate glare. Stated differently, the hood 41 may extend outward beyond the lens 32 of the camera 30 in a direction radial from an axis of rotation of the rotatable mount 35. Specifically, the hood 41 may have a first length 42 extending from the proximal end 43 of the hood 41 to the distal end 44 of the hood 41, and the camera 30 and lens 32 combination may have a second length 31 such that the first length 42 is greater than the second length 31. The hood may be configured to be adaptable to abut with or otherwise interface with a surface, including an irregular surface, to envelope the lens 32 and shield out stray light (e.g., undesired reflected light) that can produce glare.

The body 12 of the security device may also comprise a speaker 49, a motion detector 54, a microphone 58, and an ambient light sensor 60. Additionally, the body 12 may house circuitry such as a power converter, a wireless communication module, a controller, and a rechargeable battery (not visible in FIG. 1).

In various embodiments, the electrical contacts 24 may operatively communicate with complementary contacts within a light socket to transmit standard AC power to the security device 10 for operation. Internally, the device 10 may include desirable rectifier/power converter circuitry for reducing/converting the AC power (for example, standard USB, 5 volts DC, 1 amp, or 2 amp) for operation of camera components, LEDs, etc., connected to the security device 10.

Figure 2:
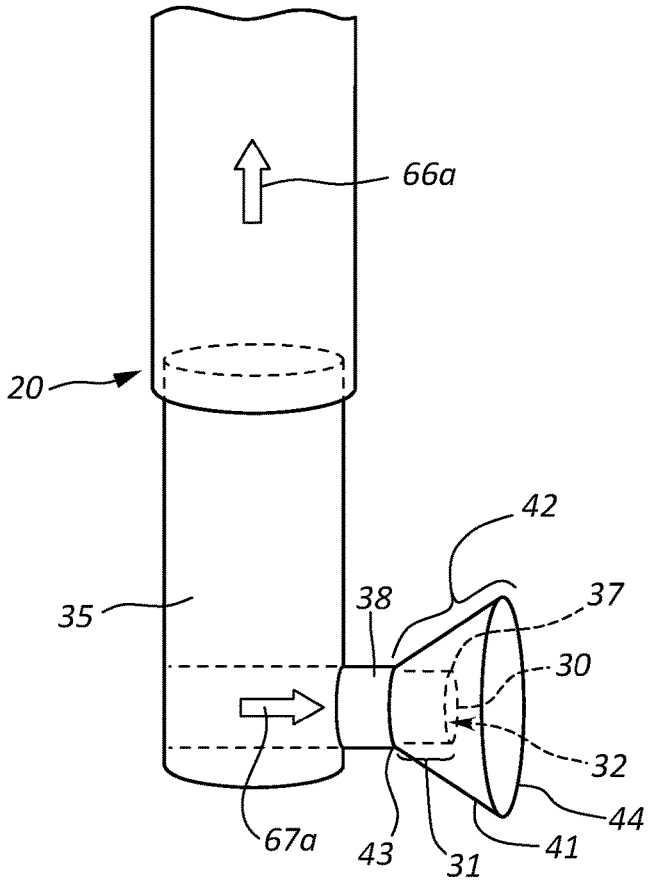
FIG. 2 is a perspective view of the security device of FIG. 1 with a mount extended and a slide retracted.
Figure 3:
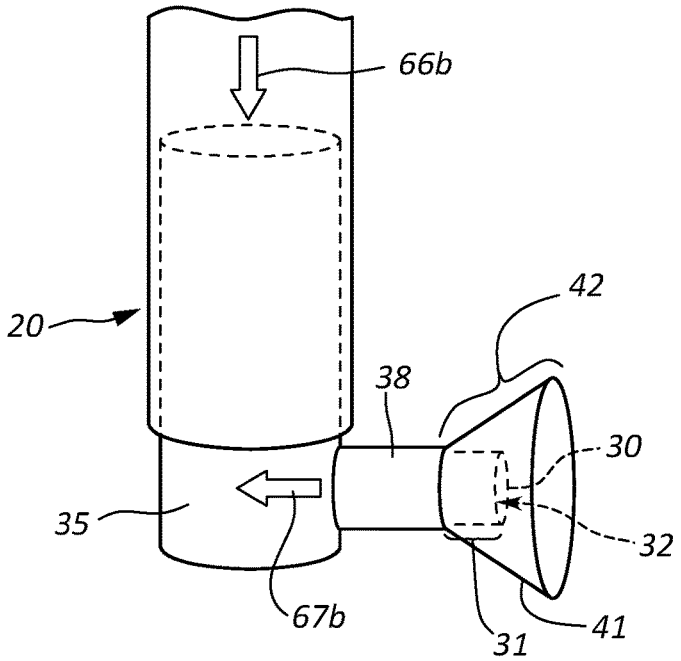
FIG. 3 is a perspective view of the security device of FIG. 1 with the mount retracted and the slide extended.

Turning now to FIGS. 2 and 3, there are shown perspective views of the second end 20 of the body 12 of the security device 10. Also shown is the mount 35 of the security device 10, and the slide 38 of the security device 10. The mount 35 may be extendable and/or rotatable, as may be the slide 38. For example, the mount 35 may be configured to telescope into the second end 20 of the body 12 of the security device 10 to be retracted and telescope out from the second end 20 of the body 12 of the security device 10 to be extended. Similarly, the slide 38 may be configured to telescope into the mount 35 of the security device 10 to be retracted and telescope out from the mount 35 of the security device 10 to be extended, i.e., the slide may be a telescope tube.

FIG. 2 shows a partial cut-away view of the second end 20 of the body 12 of the security device 10, with the mount 35 in an extended position and the slide 38 in a retracted position. According to FIG. 2, the mount 35 may be slid in an upward direction **66*a* to move inwardly into a retracted position. Also, the slide 38 may be slid in an outward direction 67***a* to move outwardly into an extended position.

FIG. 3 shows a perspective view of the second end 20 of the body 12 of the security device 10, with the mount 35 in a retracted position and the slide 38 in an extended position. According to FIG. 3, the mount 35 may be slid in a downward direction 66*b* to move outwardly into an extended position. Also, the slide 38 may be slid in an inward direction 67*b* to move inwardly into a retracted position. Such variability may allow users to place the camera 30 at a desired height and position, depending on the height of the light socket and/or light fixture with which the security device 10 may be used.

The mount 35 may also be rotatable, such that a user may rotate the mount 35 to place the camera 30 at a desired radial position. Similarly, the slide 38 may be rotatable and/or have a tilt functionality. For example, the slide 38 may tilt with the pivot point located at the point of connection between the slide 38 and the mount 35 (i.e., the first end of the slide 38). The tilt function may allow the user to angle the camera 30 to a desired orientation and have further control of the view of the camera 30. The camera 30 may be mounted to the rotatable mount 35 by the slide 38, for example, or to the end of the mount 35 if no slide 38 is provided. With a rotatable/extendable mount 35 and/or slide 38, the camera 30 may have complete manual (or automated, if gimbal motors are provided) position adjustability. Such adjustability may allow a user to place the camera 30 directly against the glass of a lighting fixture, for example, such as an outdoor carriage lamp. The camera 30 may be advanced such that the distal end 44 of the hood 41 may be pressed directly against the glass, which may reduce or eliminate problems such as glare. If, for example, the light is disposed inside a carriage lamp along the exterior of a home, the glass of the carriage lamp may distort the image. By advancing the distal end 44 of the hood 41 against the glass, the distortion may be decreased.

The hood 41 may extend around and beyond the camera 30 and lens 32 and press against a barrier such as a glass light fixture. The extended hood 41 may be designed such that the entire perimeter of the distal end 44 of the hood 41 may directly contact the glass/plastic of a lantern or sconce light fixture, for example. Such a hood 41 may further reduce persistent problems such as glare, or other interference from the light source 46 of the security device 10 or other surrounding lights. For example, if the security device 10 is provided with its own LEDs and/or IR illumination, the lighting and/or sensors may decrease the visibility of the camera 30. By isolating the camera 30 with an extended hood 41, visibility and picture quality may be increased. Providing a hood 41 to reduce glare and improve the quality of the camera 30 picture may also allow the camera 30 to be used more discreetly outdoors, such as in an existing light fixture. Such a light fixture may have an added benefit of offering some protection from the outdoor elements for the security device 10. The hood 41 may be formed of any appropriate material, such as rubber, plastic, etc. According to various embodiments, the hood 41 may be configured to have a truncated cone shape, a tapered truncated cone shape, a nested cylinder configuration, an accordion shape, or some other shape or configuration that may allow the entire perimeter of the distal end 44 of the hood 41 to conform to the surface of a light fixture or other barrier. In some embodiments, the hood 41 may be formed of a material that allows the hood 41 to bend or change shape to conform to the shape of a light fixture surface or other barrier. Stated differently, the hood 41 may be configured to be adaptable to abut with or otherwise interface with a surface of the glass, whether it is a regular (or standard) surface or an irregular surface, to envelope the lens 32 and shield out stray or errant light (e.g., undesired reflected light). The surface may be regular if it is flat, smooth and/or generally oriented orthogonal to an optical axis of the lens 32 of the camera 30. A surface may be irregular if it is not regular, such as curved, uneven, and/or generally oriented at an angle other than orthogonal to the optical axis of the lens. A surface may be regular with the camera at one position and may become irregular if the camera is tilted or otherwise changed to alter the optical axis relative to the surface.

Any type of suitable camera 30 may be used in conjunction with the security device 10. For example, a camera 30 that utilizes a fish-eye lens capable of capturing a 180-degree peripheral view may be used. Wide-angle lenses or other lenses may be used. In some configurations, multiple cameras 30 may be used in conjunction to obtain a 360-degree view. The camera 30 may include standard features known in the industry, such as night vision, high definition, wireless capability, and cloud storage for data, among other features. The particular camera 30 features implemented in the lens 32 and/or circuitry may be varied to meet the design criteria of any particular implementation.

The body 12 of the security device 10 may also be provided with one or more light sources 46. Any suitable type of light may be used. For example, LEDs may be used to conserve energy. Alternatively, standard bulbs, infrared illuminators, or a combination of such types of lights may be used. In some configurations, lighting may be incorporated into single silicone strips on the security device 10. Such light sources 46 can serve numerous functions. For example, the light sources 46 may provide sufficient lighting of the observation area to enable good image quality for the camera 30. The light sources 46 can also serve a safety purpose to light the front of a home.

Figure 4:
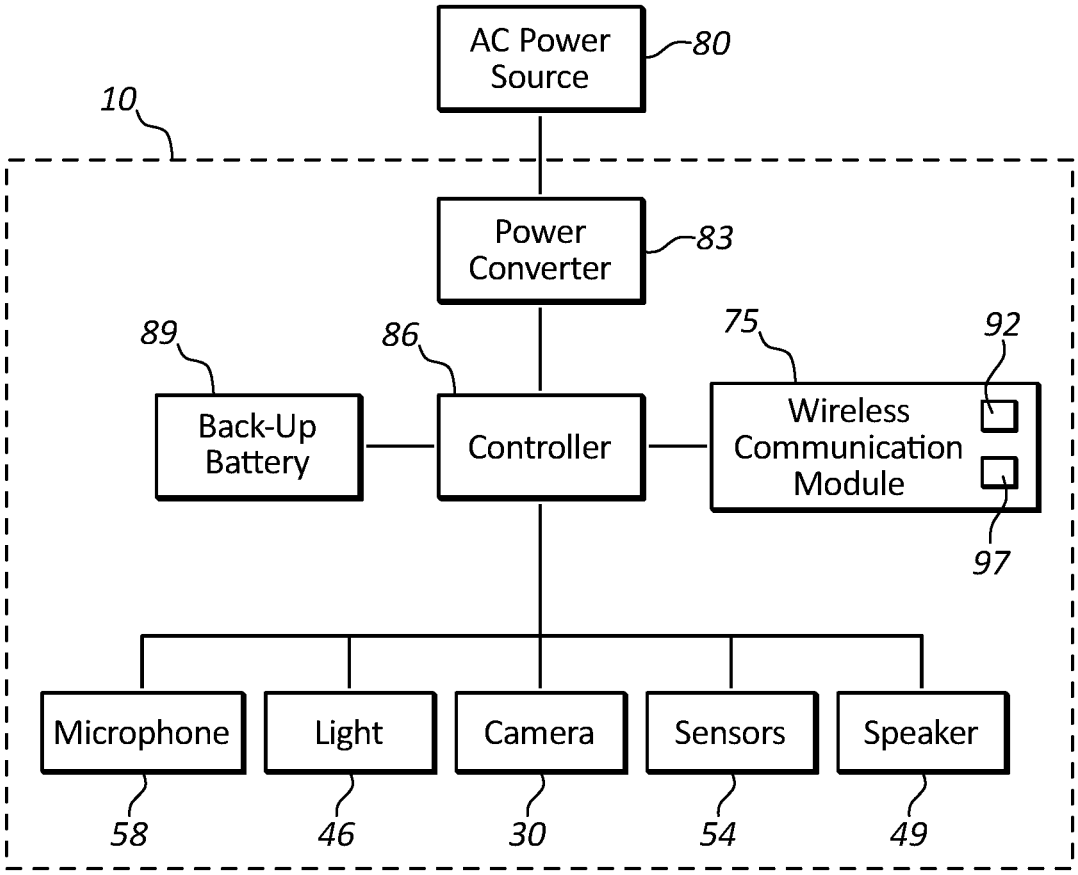
FIG. 4 is a schematic of components that may be housed in a body of the security device in connection with an AC (alternating current) power source.

FIG. 4 illustrates a schematic of the security device 10. According to the embodiment, the security device 10 may receive power from an AC power source 80 (e.g., through a light socket). The security device 10 may comprise a power converter 83, a controller 86, a back-up battery 89, and a wireless communication module 75. Further, the security device 10 may comprise a microphone 58, light sources 46, a camera 30, a motion detector 54, an ambient light sensor 60, and a speaker 49.

The AC power source 80 may be coupled to the power converter 83 of the security device 10, and the power converter 83 may be coupled to the controller 86. The controller 86 may be coupled to the back-up battery 89 and to the wireless communication module 75. Further, the controller 86 may be coupled to the microphone 58, light sources 46, camera 30, motion detector 54, ambient light sensor 60, and speaker 49.

The power converter 83 may convert AC power from the AC power source 80 to DC power and thereafter deliver the DC power to the various components of the security device 10. The back-up battery 89 may be a rechargeable battery that receives power from the power converter 83 and delivers power to the various components of the security device 10 in the event that the AC power source 80 ceases to deliver power.

The controller 86 may include, for example, storage, a processor, etc. The controller 86 may be used to communicate commands from a wireless communication module 75 to the other components of the security device 10 and similarly deliver data from the various components of the security device 10 to the wireless communication module 75. For example, the controller 86 may communicate video or image data from the camera 30 to the wireless communication module 75 to then be transmitted by the wireless communication module 75 to an external component. The controller 86 may also communicate audio data between the microphone 58, the wireless communication module 75, and the speaker 49. The controller may further communicate positioning commands received at the wireless communication module 75 to any gimbal motors of the camera 30. The light sources 46 may also be operated through the controller 86, such as for example, by an event being sensed by the motion sensor 54 and triggering the light sources 46. Similarly, the light sources 46, camera 30, speaker 49, motion detector 54, ambient light sensor 60, and microphone 58 may be controlled manually by users with access to the images and/or sounds from the camera 30 via the wireless communication module 75.

In some configurations, the light sources 46 may be connected to a controller that may control the functionality of the light sources 46. The controller may be connected to other functionalities, such as sensors, detectors, and/or a wireless module on the security device 10. For example, the light sources 46 may be motion-activated and programmed to turn on when the motion detector 54 on the body 12 of the security device 10 senses motion. Similarly, the body 12 of the security device 10 may be provided with an ambient light sensor 60 and the light sources 46 may be programmed to automatically turn on and stay on when ambient light is low. It will be appreciated that a separate motion detector 54 and ambient light sensor 60 may be provided, or a sensor with integrated motion and ambient light detecting capabilities may be provided.

The controller may also control the intensity and/or color of the light sources 46. For example, if a home owner views the picture from the camera 30 and determines that an intruder is on their porch, they may send a signal to the controller via the wireless module to have the light sources 46 flash quickly in an intense bright white color. This may alert the intruder that their presence is known and also call attention to the intruder if anyone passes by the home. It will be appreciated that many various controls and configurations for the light sources 46 may be possible, depending on the design criteria desired and are contemplated herein.

The wireless communication module 75 may include a wireless transmitter 92 and a wireless receiver 97. Any suitable wireless communication protocol or technology may be used, such as WiFi, Z-wave, Zigbee, IR, or Bluetooth. The wireless communication module 75 may be configured to connect with and send data to a local network and/or a mobile handheld device through a wireless connection. Such data may be communicated, for example, to a wireless router, a central alarm system, and/or a remote web interface or application (see FIG. 5, below). The wireless transmitter 92 may provide for transmitting images and data from the camera 30 to a computer network such as a local hard drive, a remote cloud computing drive, or both. The wireless receiver 97 of the wireless communication module 75 may allow for receiving signals via the network for operation and control of the camera 30 (e.g., positioning commands for one or more gimbal motors coupled to or used in conjunction with the camera 30, and/or focusing commands for the camera 30), light sources 46, speaker 49, microphone 58, ambient light sensor 60, motion detector 54, and/or any other additional sensors provided on/with the security device 10.

The wireless communication module 75 and controller 86 may utilize standard components known to one of ordinary skill in the art in connection with wireless transmission of signals and control of circuitry. In general, the wireless transmitter 92 and wireless receiver 97 can communicate with a wireless router or a wireless hotspot within an operating range. Once connected to a network, for example, via a home computer, signals can be transmitted for real-time viewing, or recorded and stored as desired. In some configurations, multiple devices, such as multiple smart phones, can be connected to the system for viewing or control purposes.

Figure 5:
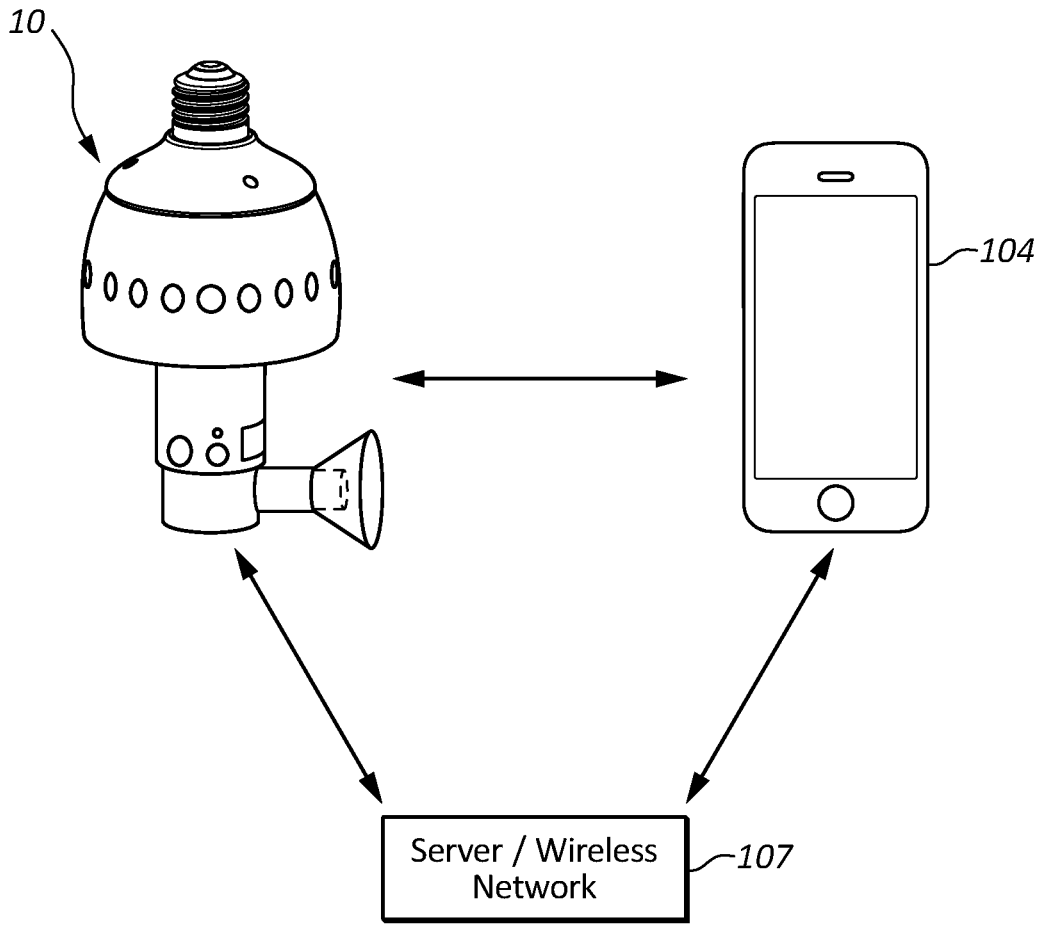
FIG. 5 is a schematic of the security device in wireless communication with a computing device and wireless network.

A web interface may provide the user with access to a system dashboard and home control via an iOS or Android smartphone or another internet-enabled device. FIG. 5 shows a schematic of a security device 10 communicating wirelessly with a computer device or remote computing device 104 and a server/wireless network 107. Video and other system data may be stored in the cloud, reducing hardware costs for the user and providing easy, reliable retrieval of information. A smartphone or tablet application may control the security device 10 remotely.

Many types of software may be used in conjunction with the security device 10 described herein. For example, facial recognition software may be used. In this example, the facial recognition software may be used to identify friendly people and/or animals from unfriendly people and/or animals. Friendly people may trigger certain sounds and/or commands for the light sources 46, while unfriendly people may trigger other sounds and/or commands for the light sources 46.

The audio capabilities of the security device 10 may be one-way to allow a user to transmit audio. According to the application, a user may use the speaker 49 without the microphone 58 to play sound. For example, the security device 10 may be programmed to play an audio message through the speaker 49 when the motion detector 54 senses motion. Alternatively, the security device 10 may allow a home owner to send their voice live through the speaker 49 to an intruder to warn them that their presence is known. In this example, a home owner may receive an alert on their computing device that motion has been detected from the motion detector 54 of the security device 10. The home owner may then view the picture of the camera 30 live and determine if the visitor is an intruder. If the visitor is an intruder, the home owner may use the speaker 49 to tell the intruder to go away. Similarly, the home owner may cause the light sources 46 to flash and alert the intruder or cause the speaker 49 to play a loud warning alarm.

Alternatively, the audio capabilities of the security device 10 may be two-way to allow a user to receive and transmit audio. According to the application, a user may use the speaker 49 in conjunction with the microphone 58 to play and record sound. For example, the security device 10 may be programmed to activate the microphone 58 when the motion detector 54 senses motion and record sound until motion ceases to be detected. The audio may be stored, saved, and/or sent to the user in real-time. According to the example, the security device 10 may also be programmed to transmit audio from the speaker 49 in real-time such that a conversation may be held through the security device 10.

Figure 6:
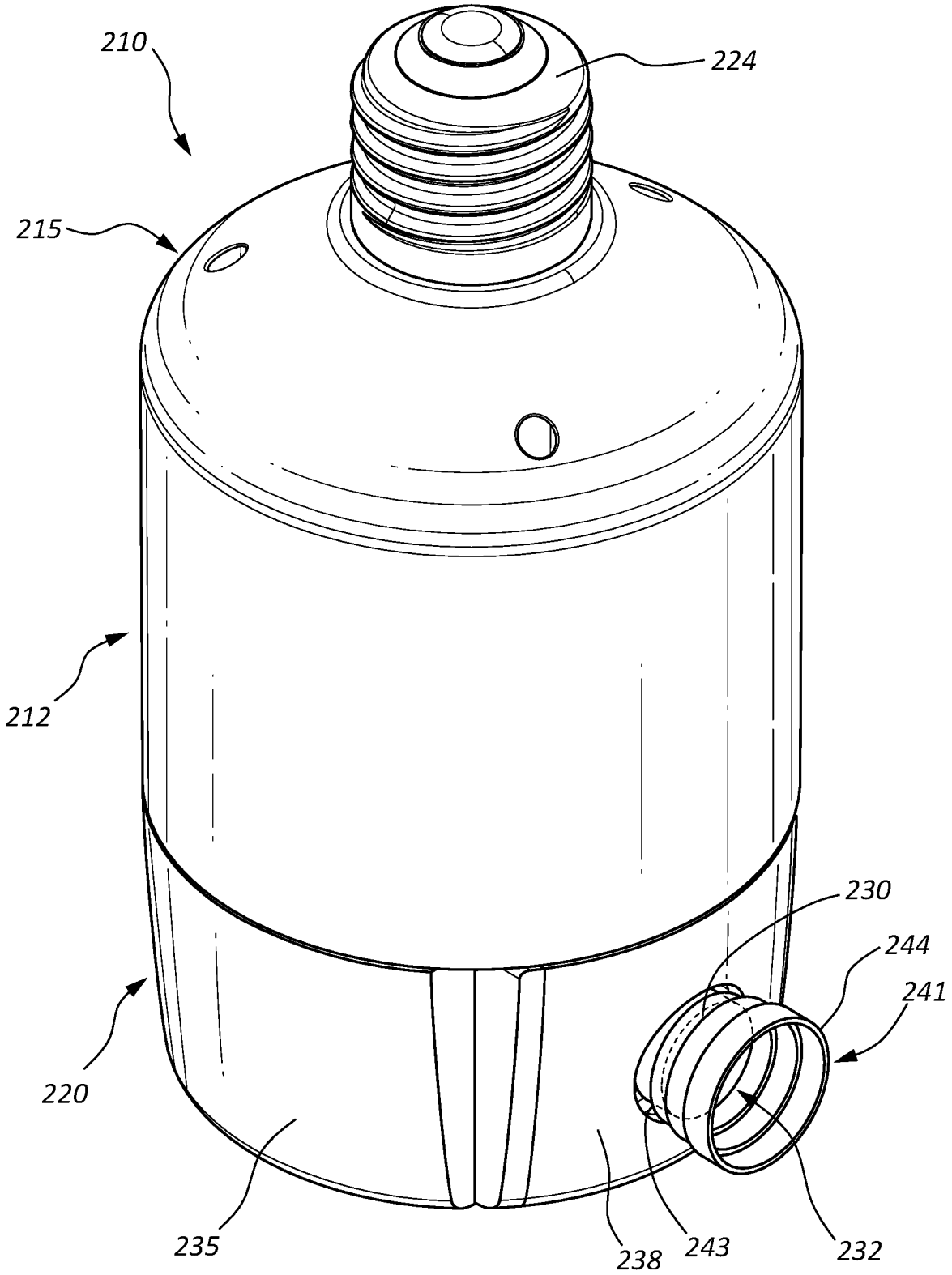
FIG. 6 is a perspective view of a security device according to one embodiment of the present disclosure.

FIG. 6 depicts an embodiment of a security device that resembles the security device 10 described above in certain respects. Accordingly, like features are designated with like reference numerals, with the leading digits incremented to "2." For example, the embodiment depicted in FIGS. 6-7 includes a body 212 that may, in some respects, resemble the body 12 of FIGS. 1-5. Relevant disclosure set forth above regarding similarly identified features thus may not be repeated hereafter. Moreover, specific features of the security device 10 and related components shown in FIGS. 1-5 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the security device 210 and related components depicted in FIGS. 6-7. Any suitable combination of the features, and variations of the same, described with respect to the security device 10 and related components illustrated in FIGS. 1-5, can be employed with the security device 210 and related components of FIGS. 6-7, and vice versa. This pattern of disclosure applies equally to further embodiments depicted in subsequent figures and described hereafter, wherein the leading digits may be further incremented.

FIG. 6 illustrates a perspective view of a security device 210 capable of being threaded into a light socket. The security device 210 of FIG. 6 comprises a light source (not shown) or light sources and a camera 230. The light sources may be disposed within the body 212 of the security device 210. The body 212 of the security device 210 may be fabricated from a transparent or translucent material to allow light to pass from the light source through the body 212. Further, the camera 230 of the security device 210 is surrounded by a hood 241 configured to have a plurality of nested cylinders.

In various applications, it may be desirable to install the security device 210 with a light fixture surrounding the device such as with an outdoor carriage lamp. In such applications, light from the light sources of the security device 210 may reflect off of the light fixture or barrier into the camera 230 of the security device 210 and distort the image being recorded by the camera 230 by creating a glare on the lens of the camera 230. The hood 241 of the security device 210 may surround the camera 230 and thereby reduce or eliminate glare. Further, the nested cylinder configuration of the hood 241 may allow the hood 241 to conform to the shape and/or angle of a light fixture or other barrier and thereby more effectively reduce or eliminate glare.

According to FIG. 6, the security device 210 comprises a body 212 that comprises a first end 215 and a second end 220. The first end 215 of the body 212 of the security device 210 may comprise electrical contacts 224 sized and threaded to mimic a light bulb base so as to be threadable into a light socket. The security device 210 may comprise an extendable and/or rotatable mount 235 that is coupled to the second end 220 of the body 212 of the security device 210. Further, the security device 210 may also comprise an extendable and/or rotatable slide 238 that may be coupled to the mount 235 and to the camera 230. The slide 238 may function as a camera movement means that extends the camera away from the body 212 and rotates the camera relative to the body 212.

The hood 241 may comprise a proximal end 243 and a distal end 244. According to FIG. 6, the proximal end 243 of the hood 241 is coupled to the slide 238 at or near the location of the lens 232 of the camera 230. The distal end 244 of the hood 241 extends beyond the lens of the camera 230. The hood 241 of FIG. 6 is configured to have a plurality of nesting cylinders, where the inner, smaller cylinders are disposed at or near the proximal end 243 of the hood 241 and the outer, larger cylinders are disposed at or near the distal end 244 of the hood 241.

The hood 241 may be configured to adapt to the surface of the glass, such that the distal end 244 abuts with or otherwise interfaces with the surface of the glass, whether it is a regular (or standard) surface or an irregular surface, to envelope the lens 232 and shield out stray or errant light (e.g., undesired reflected light).

In various applications, the mount 235 of the body 212 of the security device 210 may be configured to slide away from the base 212 of the security device 210 into an extended position or slide towards the base 212 of the security device 210 into a retracted position. The mount 235 of FIG. 6 is in a retracted position. Similarly, the slide 238 of the security device 210 may be configured to slide away from the mount 235 of the security device 210 into an extended position or slide towards the mount 235 of the security device 210 into a retracted position. The slide 238 of FIG. 6 is in a retracted position. Further, the mount 235 may be configured to be rotatable, thereby giving the mount 235 a radial variability. Also, the slide 238 may be configured to have a tilt functionality, where the slide 238 may tilt away from the mount. Such variability may allow for the camera 230 to be advanced to a position at or near the surface of a barrier such as glass from a light fixture, within which the security device 210 may be installed.

Figure 7:
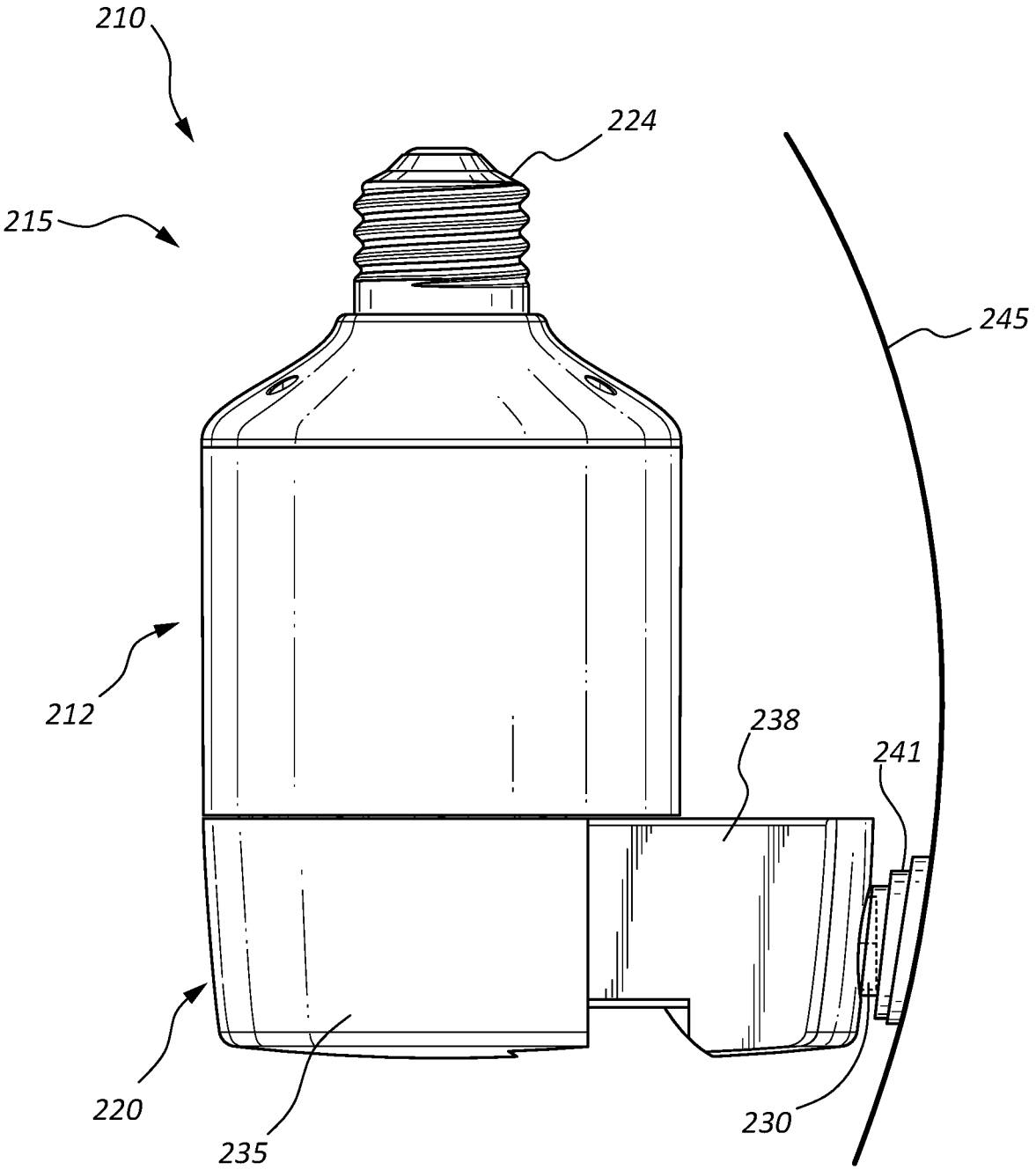
FIG. 7 is a side view of the security device of FIG. 6 with a slide extended and a hood of a camera engaged with a light feature.

FIG. 7 illustrates a side view of the security device 210 of FIG. 6, where the mount 235 is in a retracted position and the slide 238 is in an extended position. Also shown is a portion of glass from a light fixture 245. According to FIG. 7, the security device 210 is configured such that the camera 230 is advanced to be near the light fixture 245. The hood 241 of the security device 210 is positioned such that the perimeter of the distal end 244 of the hood 241 conforms to the curvature of the glass of the light fixture 245, enveloping at least a lens 232 (or a viewing surface of the lens) of the camera 230 within the hood 241 and the glass of the light fixture 245 and thereby reducing or eliminating the amount of reflected light from the light sources of the security device 210 off of the glass of the light fixture 245 into the camera 230. Specifically, according to FIG. 7, the elbows on the lower portion of the nesting cylinders of the hood 241 are configured to bend (e.g., compress and/or nest) and opposing elbows on the upper portion of the nesting cylinders of the hood 241 are configured to extend (e.g., un-nest) to enable the distal portion 244 of the hood 241 to engage (or remained engaged with) the glass of the light fixture 245. In this manner, the hood 241 can adapt to the surface of the glass, such that the distal end 244 abuts with or otherwise interfaces with the surface of the glass.

Figure 8C:
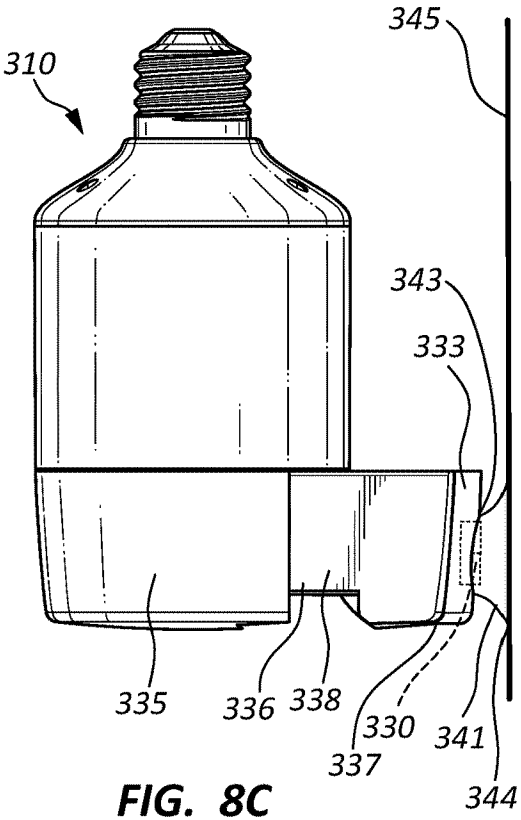
FIG. 8C is a side view of the security device of FIG. 8A with the slide extended and the truncated tapered hood pressed against a surface.
Figure 8B:
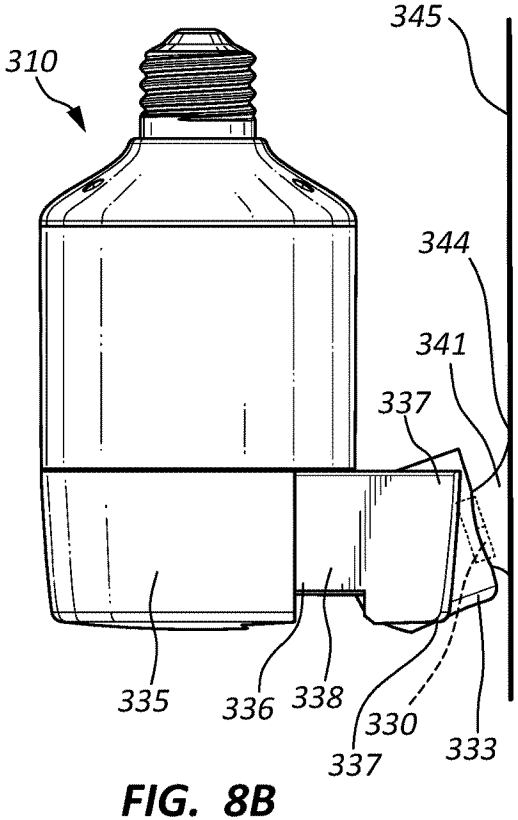
FIG. 8B is a side view of the security device of FIG. 8A with the slide extended, the camera tilted upward, and the truncated tapered hood pressed against a surface.
Figure 8A:
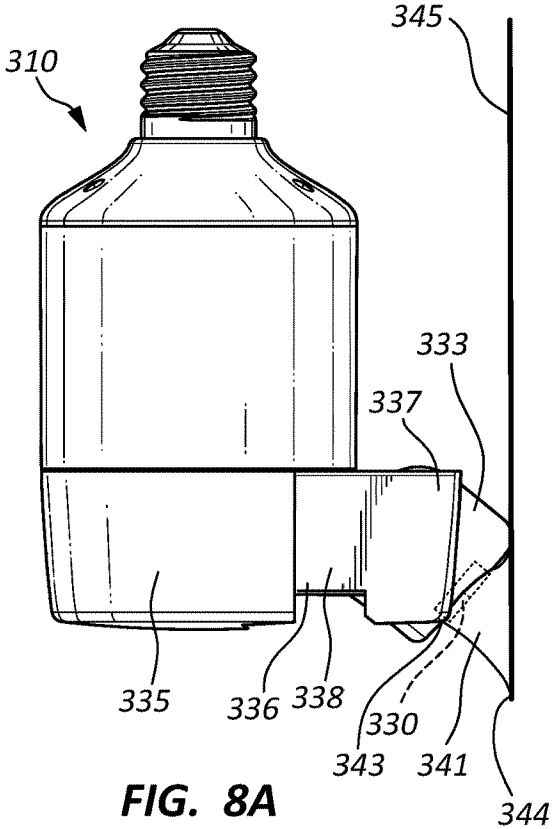
FIG. 8A is a side view of a security device according to one embodiment with a truncated tapered hood surrounding a lens of a camera, a slide extended, the camera tilted downward, and the truncated tapered hood pressed against a surface.

FIGS. 8A-8C illustrate an embodiment where a security device 310 and a camera 330 of the security device 310 are advanced to approach a glass surface 345 at a variety of angles. Specifically, FIG. 8A illustrates the camera 330 of the security device 310 angled downward near the glass surface 345 relative to the security device 310. FIG. 8B illustrates the camera 330 of the security device 310 angled upward near the glass surface 345 relative to the security device 310. FIG. 8C illustrates the camera 330 of the security device 310 angled forward near the glass surface 345 relative to the security device 310.

According to FIGS. 8A-8C, the security device 310 includes a mount 335 in a retracted position and a slide 338 in an extended position towards the glass surface 345. The slide 338 of the security device 310 comprises a proximal portion 336 and a distal portion 337. The security device 310 of FIG. 8 also comprises a rotatable portion 333 that is coupled to the distal portion 337 of the slide 338. The camera 330 of the security device 310 is coupled to the rotatable portion 333 of the security device 310, thereby allowing the camera 330 to be rotated upward and downward relative to the security device 310.

The security device 310 further comprises a hood 341 that surrounds the camera 330 and extends beyond the lens of the camera 330. The hood 341 comprises a proximal end 343 and a distal end 344. The proximal end 343 of the hood 341 may be coupled to the rotatable portion 333 of the security device 310 at or near the location of the lens of the camera 330, and the distal end 344 of the hood 341 is configured to contact the glass surface 345. According to FIG. 8, the hood 341 of the security device 310 may have a tapered truncated cone shape. The entire perimeter (e.g., circumference) of the distal end 344 of the hood 341 is configured to engage the glass surface 345 and encompass the lens of the camera 330, thereby blocking reflected light from the glass surface 345 from entering the lens of the camera 330 and reducing or eliminating glare on the image of the camera 330. In various applications, a tapered truncated cone shaped hood 341 may allow the hood 341 to bend and conform to and engage the glass surface 345, thereby reducing distortions caused by glare and other relevant factors on the image quality.

FIG. 8A illustrates the security device 310 with the rotatable portion 333 of the security device 310 angled downward relative to the security device 310. According to FIG. 8A, the upper portion of the hood 341 is configured to bend and the lower portion of the hood 341 is configured to extend to enable the hood 341 to engage the glass surface 345 when the rotatable portion 333 of the security device 310 is angled downward, thereby preserving the image quality of the camera 330 when the camera 330 is angled downward.

FIG. 8B illustrates the security device 310 with the rotatable portion 333 of the security device 310 angled upward relative to the security device 310. According to FIG. 8B, the upper portion of the hood 341 is configured to extend and the lower portion of the hood 341 is configured to bend to enable the hood 341 to engage the glass surface 345 when the rotatable portion 333 of the security device 310 is angled upward, thereby preserving the image quality of the camera 330 when the camera 330 is angled upward.

FIG. 8C illustrates the security device 310 with the rotatable portion 333 of the security device 310 angled forward relative to the security device 310. According to FIG. 8C, the upper portion of the hood 341 is configured to bend the same amount as the lower portion of the hood 341 to enable the hood 341 to engage the glass surface 345 when the rotatable portion 333 of the security device 310 is angled forward, thereby preserving the image quality of the camera 330 when the camera 330 is angled forward.

In various applications the rotatable portion 333 of the security device 310 may be rotated automatically (e.g., by gimbal motors used in conjunction with the security device 310 or by other similar mechanisms) to change the viewing angle of the camera 330. In such applications, portions of the hood 341 may bend and extend to enable the hood 341 to continue to engage the glass surface 345 during rotation of the rotatable portion 333 of the security device 310.

Figure 9C:
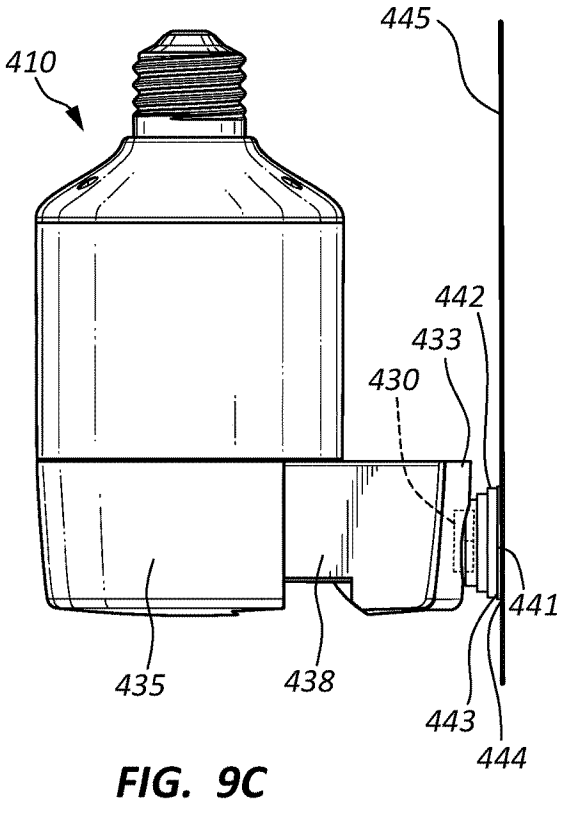
FIG. 9C is a side view of the security device of FIG. 9A with the slide extended and the nested hood pressed against a surface.
Figure 9B:
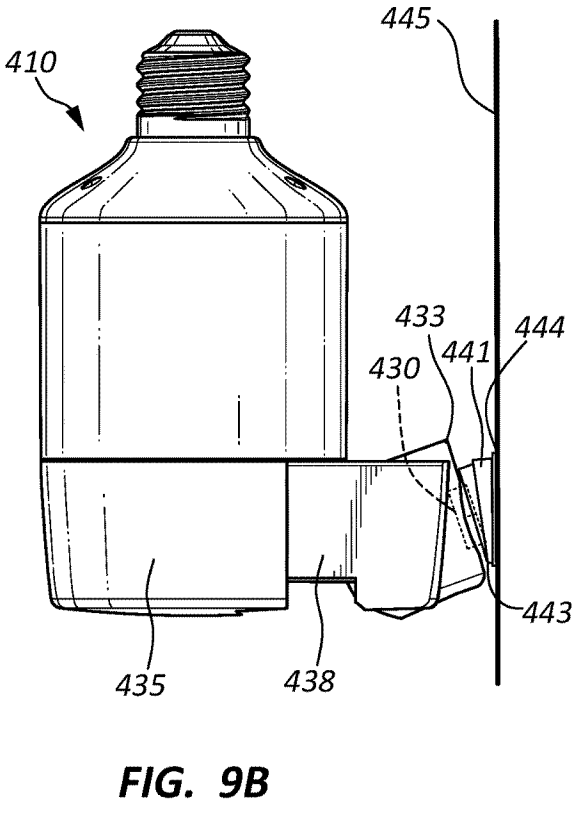
FIG. 9B is a side view of the security device of FIG. 9A with the slide extended, the camera tilted upward, and the nested hood pressed against a surface.
Figure 9A:
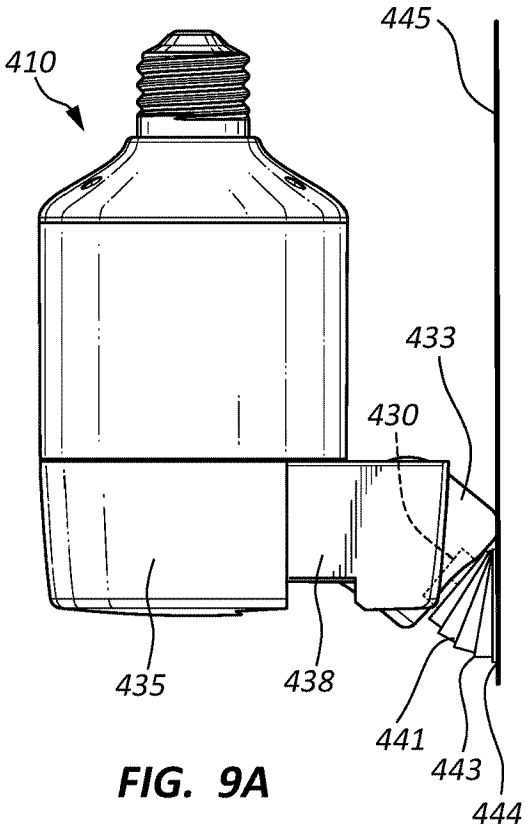
FIG. 9A is a side view of a security device according to one embodiment with a nested hood surrounding a lens of a camera, a slide extended, the camera tilted downward, and the nested hood pressed against a surface.

FIGS. 9A-9C illustrate an embodiment of a security device 410 and a camera 430 of the security device 410 is advanced to approach a glass surface 445 at a variety of angles. Specifically, FIG. 9A illustrates the camera 430 of the security device 410 angled downward near the glass surface 445 relative to the security device 410, FIG. 9B illustrates the camera 430 of the security device 410 angled upward near the glass surface 445 relative to the security device 410, and FIG. 9C illustrates the camera 430 of the security device 410 angled forward near the glass surface 445 relative to the security device 410.

According to FIGS. 9A-9C, the hood 441 of the security device 410 is configured to have a plurality of nested cylinders. The entire perimeter (e.g., circumference) of the distal end 444 of the hood 441 is configured to engage the glass surface 445 and encompass the lens of the camera 430, thereby blocking reflected light from the glass surface 445 from entering the lens of the camera 430 and reducing or eliminating glare on the image of the camera 430. In various applications, a configuration where the hood 441 has a plurality of nested cylinders may allow portions of the hood 441 to bend to conform to and engage the glass surface 445, thereby reducing distortions caused by glare and other relevant factors on the image quality.

FIG. 9A illustrates the security device 410 with the rotatable portion 433 of the security device 410 angled downward relative to the security device 410. According to FIG. 9A, elbows 442 of the nesting cylinders on the upper portion of the hood 441 are configured to bend and elbows 443 of the nesting cylinders on the lower portion of the hood 441 are configured to extend to enable the hood 441 to engage the glass surface 445 when the rotatable portion 433 of the security device 410 is angled downward, thereby preserving the image quality of the camera 430 when the camera 430 is angled downward.

FIG. 9B illustrates the security device 410 with the rotatable portion 433 of the security device 410 angled upward relative to the security device 410. According to FIG. 9B, elbows 442 of the nesting cylinders on the upper portion of the hood 441 are configured to extend and elbows 443 of the nesting cylinders on the lower portion of the hood 341 are configured to bend to enable the hood 441 to engage the glass surface 445 when the rotatable portion 433 of the security device 410 is angled upward, thereby preserving the image quality of the camera 430 when the camera 430 is angled upward.

FIG. 9C illustrates the security device 410 with the rotatable portion 433 of the security device 410 angled forward relative to the security device 410. According to FIG. 9C, elbows 442 of the nesting cylinders on the upper portion of the hood 441 are configured to bend the same amount as elbows 443 of the nesting cylinders on the lower portion of the hood 441 to enable the hood 441 to engage the glass surface 445 when the rotatable portion 433 of the security device 410 is angled forward, thereby preserving the image quality of the camera 430 when the camera 430 is angled forward.

In various applications the rotatable portion 433 of the security device 410 may be rotated automatically (e.g., by gimbal motors used in conjunction with the security device 410 or by other similar mechanisms) to change the viewing angle of the camera 430. In such applications, elbows 442 and 443 of the nesting cylinders on portions of the hood 441 may bend and/or extend to enable the hood 441 to continue to engage the glass surface 445 during rotation of the rotatable portion 433 of the security device 410.

Figure 10C:
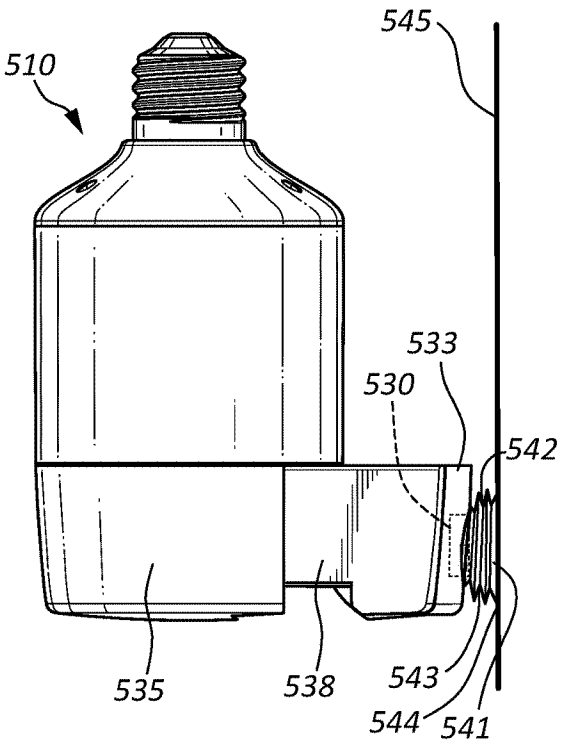
FIG. 10C is a side view of the security device of FIG. 10A with the slide extended, the camera tilted forward, and the accordion shaped hood pressed against a surface.
Figure 10B:
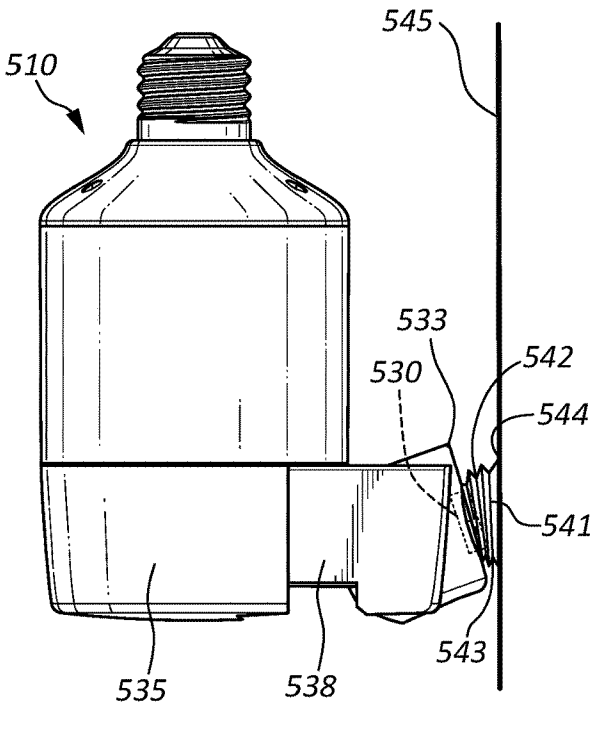
FIG. 10B is a side view of the security device of FIG. 10A with the slide extended, the camera tilted upward, and the accordion shaped hood pressed against a surface.
Figure 10A:
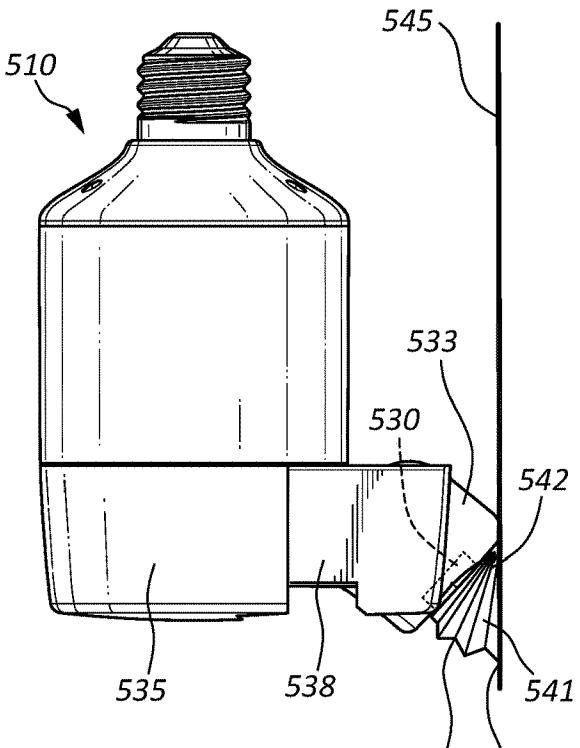
FIG. 10A is a side view of a security device according to one embodiment with an accordion shaped hood surrounding a lens of a camera, a slide extended, a camera tilted downward, and the accordion shaped hood pressed against a surface.

FIGS. 10A-10C illustrate an embodiment of a security device 510 and a camera 530 of the security device 510 is advanced to approach the glass surface 545 at a variety of angles. Specifically, FIG. 10A illustrates the camera 530 of the security device 510 angled downward near the glass surface 545 relative to the security device 510, FIG. 10B illustrates the camera 530 of the security device 510 angled upward near the glass surface 545 relative to the security device 510, and FIG. 10C illustrates the camera 530 of the security device 510 angled forward near the glass surface 545 relative to the security device 510.

According to FIGS. 10A-10C, the hood 541 of the security device 510 is configured to have an accordion shape. The perimeter (e.g., circumference) of the distal end 544 of the hood 541 is configured to engage the glass surface 545 and encompass the lens of the camera 530, thereby blocking reflected light from the glass surface 545 from entering the lens of the camera 530 and reducing or eliminating glare on the image of the camera 530 may be reduced or eliminated. In various applications, a configuration where the hood 541 has an accordion shape may allow portions of the hood 541 to bend to conform to and engage the glass surface 545, thereby reducing distortions caused by glare and other relevant factors on the image quality.

FIG. 10A illustrates the security device 510 with the rotatable portion 533 of the security device 510 angled downward relative to the security device 510. According to FIG. 10A, elbows 542 on the upper portion of the accordion shaped hood 541 are configured to bend and elbows 543 on the lower portion of the accordion shaped hood 541 are configured to extend to enable the hood 541 to engage the glass surface 545 when the rotatable portion 533 of the security device 510 is angled downward, thereby preserving the image quality of the camera 530 when the camera 530 is angled downward.

FIG. 10B illustrates the security device 510 with the rotatable portion 533 of the security device 510 angled upward relative to the security device 510. According to FIG. 10B, elbows 542 on the upper portion of the accordion shaped hood 541 are configured to extend and elbows 543 on the lower portion of the accordion shaped hood 541 are configured to bend to enable the hood 541 to engage the glass surface 545 when the rotatable portion 533 of the security device 510 is angled upward, thereby preserving the image quality of the camera 530 when the camera 530 is angled upward.

FIG. 10C illustrates the security device 510 with the rotatable portion 533 of the security device 510 angled forward relative to the security device 510. According to FIG. 10C, elbows 542 on the upper portion of the accordion shaped hood 541 are configured to bend the same amount as elbows 543 on the lower portion of the accordion shaped hood 541 to enable the hood 541 to engage the glass surface 545 when the rotatable portion 533 of the security device 510 is angled forward, thereby preserving the image quality of the camera 530 when the camera 530 is angled forward.

In various applications the rotatable portion 533 of the security device 510 may be rotated automatically (e.g., by gimbal motors used in conjunction with the security device 510 or by other similar mechanisms) to change the viewing angle of the camera 530. In such applications, elbows 542 and 543 on portions of the accordion shaped hood 541 may bend and/or extend to enable the hood 541 to continue to engage the glass surface 545 during rotation of the rotatable portion 533 of the security device 510.

Figure 11A:
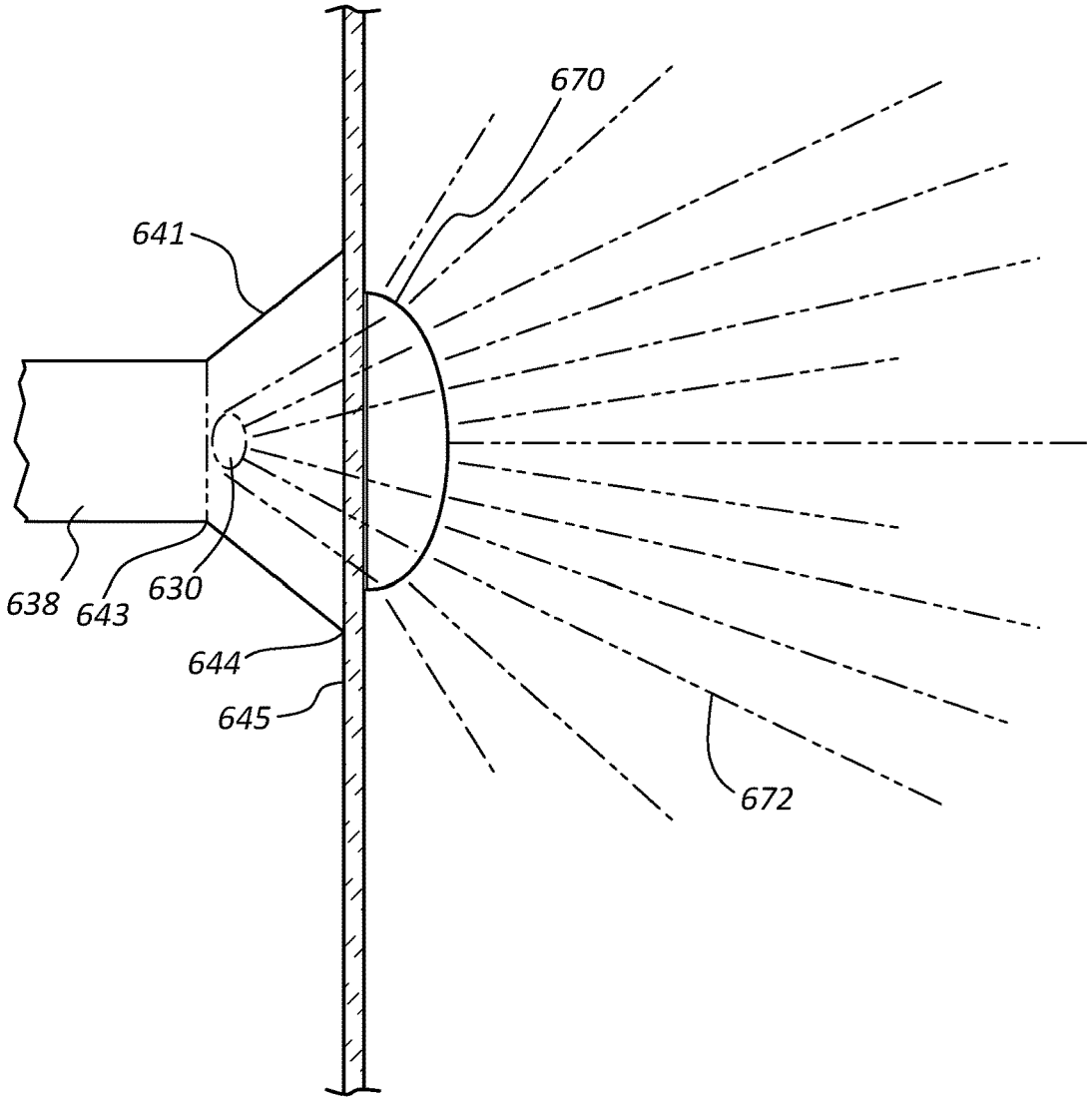
FIG. 11A is a side view of a portion of a security device according to one embodiment where a hood surrounding a lens of a camera is pressed against a flat surface and a fisheye lens is coupled to the other side of the surface.
Figure 11B:
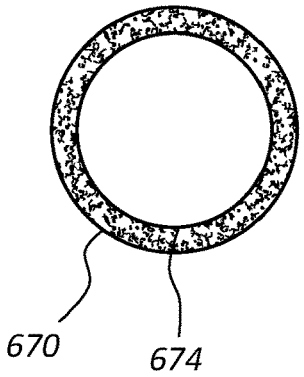
FIG. 11B is a rear view of the fisheye lens of FIG. 11A.

FIG. 11A illustrates a side view of a portion of a security device similar to the security device 10 of FIG. 1. In particular, the slide 638, camera 630, and hood 641 of the security device are shown, where the hood 641 of the security device is advanced against a glass surface 645. The glass surface 645 comprises a first side 646 and a second side 647 on the same plane as the first side 646. According to the embodiment in FIG. 11A, the hood 641 of the security device is advanced against the first side 646 of the glass surface 645. Further, the security device may include a fisheye lens attachment 670 is coupled to the second side 647 (e.g., opposing the first side 646) of the glass surface 645 in a security system kit. Also shown in FIG. 11B, an adhesive 674 may be used to couple the fisheye lens attachment 670 to the glass surface 645. The fisheye lens attachment 670 may be coupled to the second side 647 of the glass of the light features to which the camera lens is aimed. The fisheye lens attachment 670 may enlarge a field of view of the camera lens.

Light from the security device may reflect off of the glass surface 645 into the lens of the camera 630 of the security device, thereby causing a glare to distort the image captured by the camera 630. The hood 641 of the security device may surround the lens of the camera 630 and thereby reduce glare and improve the quality of the image captured by the camera 630. The hood 641 comprises a proximal end 643 and a distal end 644, where the proximal end 643 is coupled to the slide 638 of the security device at or near the location of the lens of the camera 630, and where the distal end 644 extends beyond the lens of the camera 630. The fisheye lens attachment 670 may allow for a wider viewing range to be captured by the camera 630 by bending the angle at which external light 672 enters the lens of the camera 630. The adhesive 674 may be configured to take the shape of the perimeter of the fisheye lens attachment 670, thereby allowing the fisheye lens attachment 670 to be coupled to the glass surface 645 without the adhesive 674 causing any distortion to the image captured by the camera 630 of the security device.

Figure 12:
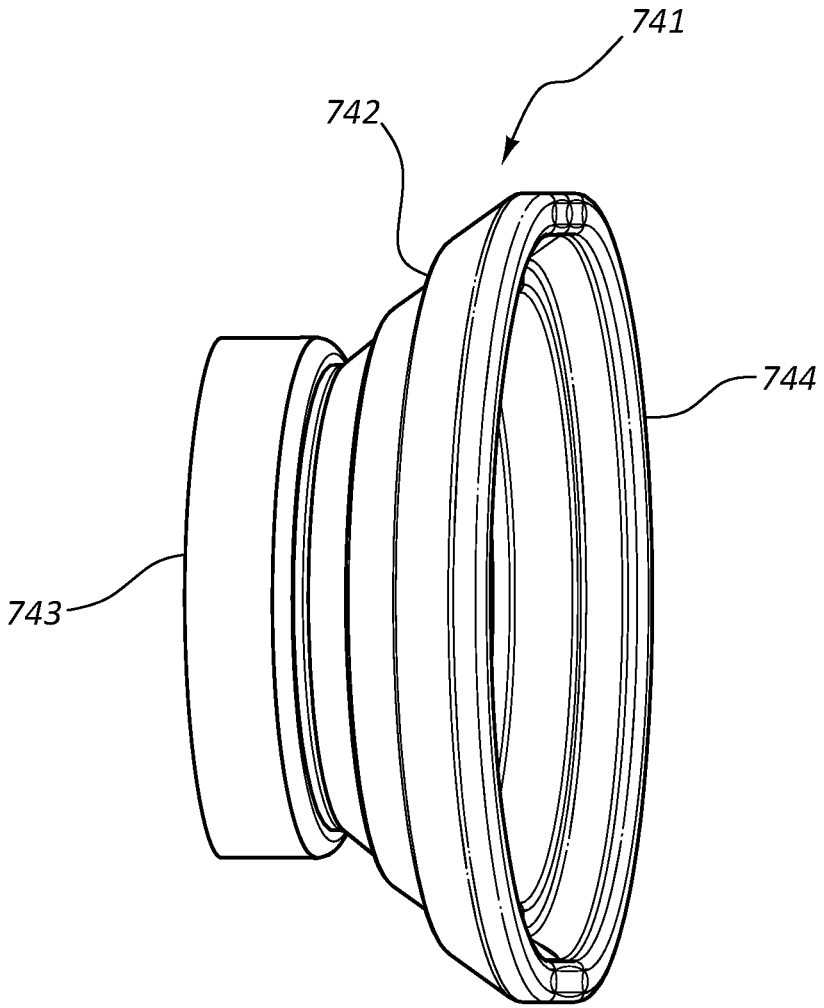
FIG. 12 is a perspective view of a hood, according to one embodiment.

In some embodiments, the hood may be a separate component from the security device and may be attachable to (and detachable from) the security device or to another camera. FIG. 12 illustrates a hood 741 as a separate component that is not attached to a security device. The security device 741 has a plurality of nesting cylinders and elbows 742. However, the shape of the hood 741 may be similar to any of the other hoods disclosed herein. The hood 741 may have a distal end 744 and a proximal end 743. The proximal end 743 of the hood 741 may be attachable/detachable to a security device described herein, or may be attachable to a variety of different cameras. The proximal end 743 may be attached by to camera by adhesives, mechanical interactions, press fit, etc. In some embodiments, the proximal end 743 may have an adhesive that is protected by a tab that is removable. Once the tab is removed the adhesive is exposed and the adhesive on the proximal end 743 of the hood 741 may be used to attach the proximal end 743 to a camera and encompass the camera's lens, thereby reducing glare on the camera's lens.

In some embodiments, after the hood 741 is attached to a camera or security device, the distal end 744 of the hood 741 may be configured to engage with or otherwise interface with a transparent material to enable the camera to see through the material. In some embodiments, the transparent material may be a window glass, plastic materials, etc. The distal end 744 of the hood 741 may create suction between the hood 741 and the transparent material. Suction between the hood 741 and the transparent material enables the hood 741 to encompass the camera's lens to prevent glare and enable the camera's lens to see through the transparent material to capture images or video on the other side of the transparent material. The suction feature of hood 741 may also be implemented with any other the other hoods disclosed herein.

Any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified. Moreover, sub-routines or only a portion of a method described herein may be a separate method within the scope of this disclosure. Stated otherwise, some methods may include only a portion of the steps described in a more detailed method.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated by one of skill in the art with the benefit of this disclosure that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. Elements recited in means-plus-function format are intended to be construed in accordance with 35 U.S.C. § 112(f). It will be apparent to those having skill in the art that changes may be made to the details of the above-described embodiments without departing from the underlying principles of the present disclosure.

I claim:

1. A security device comprising:

a body comprising a first end and a second end, the first end being threadable into a light socket;

a slide coupled to the second end and configured to extend away from the second end;

a camera with a lens disposed on a distal portion of the slide, wherein the distal portion of the slide rotates relative to the slide along an axis of rotation orthogonal to the longitudinal axis of the slide; and a hood surrounding the lens of the camera, wherein a distal end of the hood is configured to create suction between the hood and a transparent material of a light fixture.

2. The security device of claim 1, further comprising a light source disposed on the body of the security device.

3. The security device of claim 1, wherein the hood extends beyond the lens of the camera.

4. The security device of claim 1, wherein the distal end of the hood is configured to engage with the transparent material of the light fixture and envelop at least the lens within the hood and the transparent material of the light fixture.

5. The security device of claim 1, wherein the hood further comprises:

a body with the proximal end and the distal end;

a first opening disposed at the proximal end of the body; and a second opening disposed at the distal end of the body, wherein a perimeter of the first opening is couplable to the distal end of the slide of the security device such that the body is disposed around and envelops the lens of the camera of the security device.

6. The security device of claim 5, wherein a perimeter of the second opening creates suction between the perimeter of the second opening and the transparent material of the light fixture.

7. The security device of claim 5, wherein a breadth of the proximal end of the body is less than the breadth of the distal end of the body.

8. The security device of claim 5, wherein a breadth of the body increases from the proximal end to the distal end of the body.

9. The security device of claim 5, wherein the body comprises a tapered truncated cone shape.

10. The security device of claim 5, wherein the body has a plurality of nesting cylinders and elbows disposed between adjacent nesting cylinders of the body.

11. The security device of claim 5, wherein the body is accordion shaped and comprises a plurality of elbows.

* * * * *